US006263630B1

(12) United States Patent
Bennett

(10) Patent No.: US 6,263,630 B1
(45) Date of Patent: Jul. 24, 2001

(54) MULTI-COLORED CO-EXTRUDED CORNER GUARD

(75) Inventor: Matthew G. Bennett, New Berlin, WI (US)

(73) Assignee: Inpro Corporation, Muskego, WI (US)

( * ) Notice: Subject to any disclaimer, the term of this patent is extended or adjusted under 35 U.S.C. 154(b) by 0 days.

(21) Appl. No.: 09/598,795

(22) Filed: Jun. 21, 2000

(51) Int. Cl.[7] ..... B44F 7/00

(52) U.S. Cl. ..... 52/312; 52/287.1; 52/288.1; 52/311.1; 52/174

(58) Field of Search ..... 52/287.1, 288.1, 52/311.1, 311.2, 312, 174, 105

(56) References Cited

U.S. PATENT DOCUMENTS

| | | |
|---|---|---|
| 3,458,386 | 7/1969 | Shanok et al. . |
| 5,001,877 | 3/1991 | Edwards . |
| 5,157,886 | 10/1992 | Azzar et al. . |
| 5,481,845 | 1/1996 | Koenig, Jr. . |
| 5,661,936 | 9/1997 | Ellingson . |
| 5,743,064 | 4/1998 | Bennett . |
| 6,044,601 | 4/2000 | Chmela et al. . |

*Primary Examiner*—Carl D. Friedman
*Assistant Examiner*—Naoko Slack
(74) *Attorney, Agent, or Firm*—Boyle, Fredrickson, Newholm; James F. Boyle

(57) ABSTRACT

A corner guard assembly for protecting the corner of a building wall particularly in institutional type facilities from damage due to impacts with wheeled vehicles includes an elongated vinyl corner guard member angled to fit over the corner formed by the intersection of two wall surfaces, the corner member being comprised of two different colors of vinyl plastic material that have been co-extruded to form a single, integrated product. The multi-colored corner guard provides an aesthetically improved corner guard that may be used in a wide range of interior designs. Additionally, the improved corner guard disclosed herein may be used a part of a system of color-coding the hallways of a large hospital or other institutional facility. The corner guard of the present invention may be constructed as either a tape-on corner guard that is mounted by an adhesive directly to the wall surfaces, or constructed as an assembly comprised of a base plate and cover guard.

15 Claims, 3 Drawing Sheets

MULTI-COLORED CO-EXTRUDED CORNER GUARD

BACKGROUND OF THE INVENTION

1. Field of the Invention

The present invention relates to a corner guard for protecting the corners of walls in institutional facilities, and relates in particular to a multi-colored, co-extruded corner guard.

2. Discussion of the Related Art

In institutional facilities such as hospitals, elderly care centers, and other public buildings, the corner of building walls are exposed to damage from impact resulting from forceful contact with various kinds of wheeled vehicles, such as stretchers, wheelchairs, dining carts and the like. For this reason, the corners of the building wall are commonly provided with a corner guard that will protect the wall surfaces from damage resulting from the impact.

Conventional corner guards are normally comprised of an elongated plastic member that is angled to fit over the corner formed by the intersection of two walls. The corner guard may be fastened to the wall with an adhesive, such as double-sided adhesive tape. Alternatively, the corner guard may be comprised of an assembly that includes a base plate which overlays the wall surfaces at the corner, and further includes a cover member that is attached over the base plate. For both the adhesive and mounted types of corner guards, the outer plastic corner guard member from damage due to impacts by wheeled carts and that like that occasionally hit the walls and corners of hallways.

Examples of conventional corner guard assemblies include the devices disclosed in U.S. Pat. No. 3,717,968 issued to Robert W. Olsen, et al, U.S. Pat. No. 4,430,883 issued to Claude P. Balzer et al, and U.S. Pat. No. 5,363,617 issued to Donald W. Miller.

Conventional corner guards and corner guard assemblies are typically manufactured by extruding a plastic resin into long pieces of a desired shape and color. Thus, conventional corner guards are comprised of a single grade and color of plastic material. Such single color corner guards are commonly considered bland and aesthetically undesirable. There is of course a continual demand to improve upon the aesthetic features and interior design of living and work spaces. Additionally, in hospitals and other large institutional facilities, the hallways are often color-coded to designate particular departments and locations within the building. The color-coding of hallways also provides a means of directional marking to assist users and visitors traversing through the building. Single-color corner guards, however, conform to the color scheme of one hallway or the other, but normally not both.

Accordingly, a corner guard that has improved aesthetic qualities and that will enhance the color-coding schemes of large institutional facilities is desired.

SUMMARY OF THE INVENTION

An improved corner guard designed especially for use in institutional type facilities is presented. The corner guard of the present invention includes an elongated vinyl corner member angled to fit over the corner formed by the intersection of two wall surfaces, the corner member being comprised of two different colors of vinyl plastic material that have been co-extruded to form a single, integrated product. The corner guard of the present invention provides an aesthetically improved corner guard that may be used in a much wider range of interior designs. Additionally, the improved corner guard disclosed herein may be used a part of a system of color-coding the hallways of a large hospital or other institutional facility. The corner guard of the present invention may be constructed as either a tape-on corner guard that is mounted by an adhesive directly to the wall surfaces, or constructed as an assembly comprised of a base plate and cover guard.

The present invention protects the corner of intersecting hallways from impacts and collisions, provides a visual enhancement to the interior design of buildings, and provides a multi-colored component for use in the color-coding of hallways and passageways in buildings. Other objects and advantages of the invention will become apparent from the following detailed description, which, together with the accompanying drawings, sets forth by way of illustration and example certain preferred embodiments of the present invention.

BRIEF DESCRIPTION OF THE DRAWINGS

The drawings, which constitute a part of this specification and include an exemplary embodiment of the present invention, include the following.

DETAILED DESCRIPTION OF THE PREFERRED EMBODIMENTS

Figure 1:
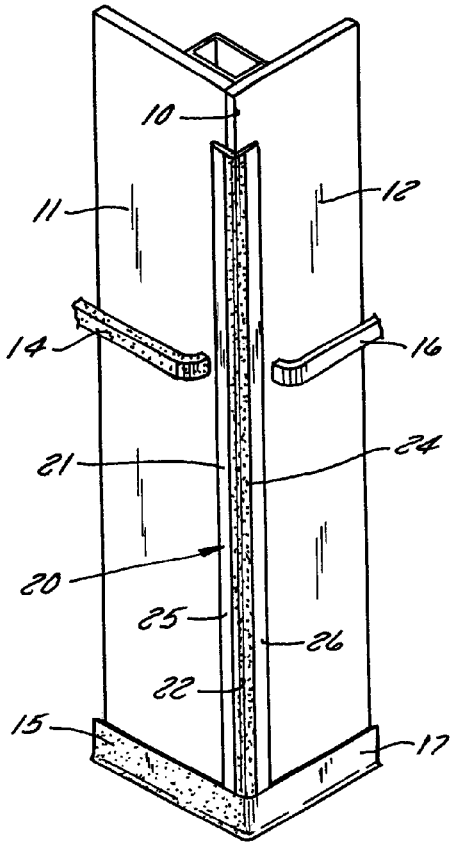
FIG. 1 is a perspective view illustrating the corner guard of the present invention assembled to type corner of a building wall.
Figure 2:
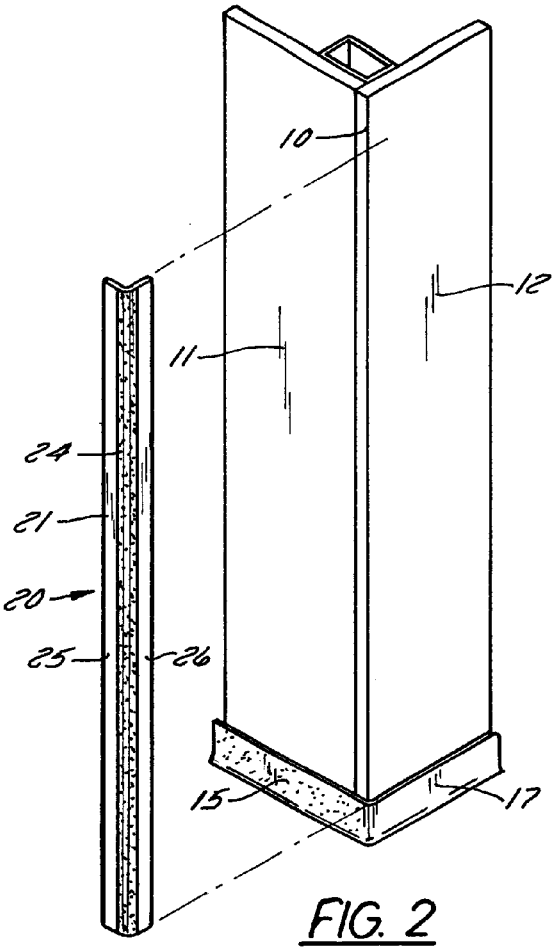
FIG. 2 is an exploded view illustrating the corner guard of the present invention and the manner in which it is assembled to the corner of a building wall.
Figure 3:
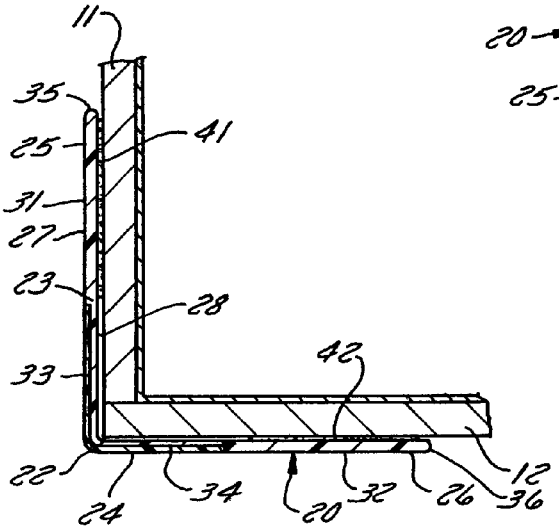
FIG. 3 is a cross section view of the corner guard of the present invention, shown assembled to the corner of a building wall.
Figure 4:
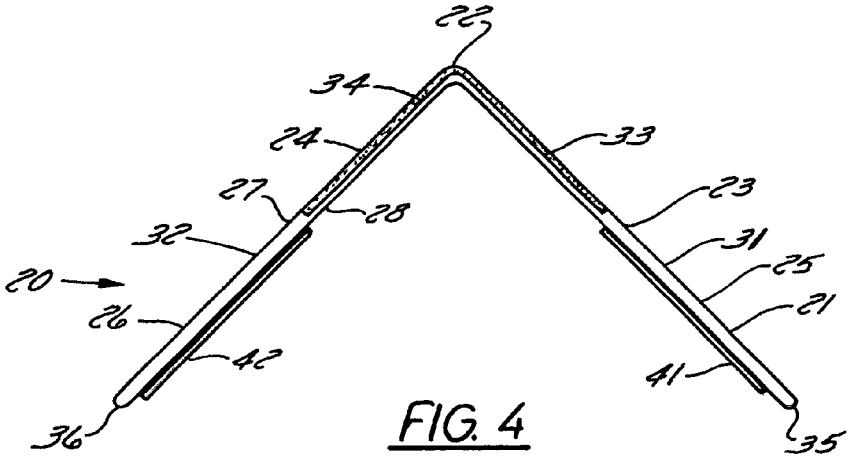
FIG. 4 is an end view of the corner guard of the present invention.

Referring to FIGS. 1, 2 and 3, a corner 10 of a building wall is defined by the intersection of two wall surfaces. The corner may be formed by assembling at right angles a first panel 11 and a second panel 12 of drywall, sheetrock, or the like. The walls define hallways and corridors for directing pedestrians and wheeled vehicles such as carts, mobile tables, wheelchairs and the like through the building. Thus the corner is subject to impact from such vehicles occasionally striking the corner of the wall with various degrees of force. Accordingly, a corner guard 20 is applied to the corner of the building wall.

The present invention of a multi-colored co-extruded corner guard 20 is comprised of a corner guard member 21 and a means for fastening the corner guard member 21 to the corner 10 of the building wall. The corner guard member 21 is an elongated member that is comprised of a first flat planar portion 25 and a second flat planar portion 26. The two flat planar portions, which intersect each other at an apex 22, extend the entire length of the corner guard member 21. The first flat planar portion 25 is applied over the first wall surface 11, and the second flat planar portion 26 is applied over the second wall surface 12. The apex 22 abuts directly against the sharp corner 10 of the intersecting wall surfaces 11 and 12. The apex 22 preferably has small radius to provide a smoother finish to the corner of the wall.

The first flat planar portion 25 intersects the second flat planar portion 26 preferably at an angle that corresponds to the angle of intersection of the first and second wall surfaces 11 and 12, which normally should be about 90°. The corner guard member 21 is made preferably of a thermoplastic material, preferably an extruded polyvinyl chloride plastic material (PVC). In the construction of building walls, the two intersecting wall surfaces 11 and 12 that form the corner 10 are occasional assembled together in a manner that does not form a precise right angle. In that event, the thermoplastic corner guard member 21 may be flexed a slight amount in order to properly fit over the corner of the building wall to which the corner guard 20 is being applied.

As mentioned, the corner guard member 21 is fabricated preferably from a rigid PVC material. Rigid polyvinyl chlorides normally have little or no plasticizer added to the material. One particular grade of material that is known to work satisfactorily is Synergistics Polycor D1015 Natural. The material comes in pellets that are melted and extruded through a die to form the retainer member. The properties of this material include a Shore D hardness scale according to ASTM Standard D2240 of about 80, and a tensile strength according to ASTM Standard D638 of about 6800 psi. This particular material is also available in a variety of colors. Other comparable materials having similar characteristics may be available in the market.

The corner guard member 21 is further comprised of at least two colors of thermoplastic material that are simultaneously co-extruded and bonded together in order to form a single integrated product. The corner guard member 21 of the present invention may be fabricated by thermo-bonding one layer of one color thermoplastic material to a second layer of a second color of thermoplastic material in such a manner that both layers are exposed to the outer surface 27 of the corner guard and thus visible from the hallways. Additionally, the layers are bonded to each other so that the final product has a constant thickness across its entire width.

Specifically, the first flat planar portion 25 includes a first outer portion 31 adjacent the edge 35 of the corner guard member 21, and the first flat planar portion 25 further includes a first inner portion 33 adjacent the apex 22 of the corner guard member 21. Additionally, the second flat planar portion 26 includes a second outer portion 32 adjacent the other edge 36 of the corner guard member 21, and the second flat planar portion 26 further includes a second inner portion 34 also adjacent the apex 22 of the corner guard member 21. A first layer 23 of thermoplastic material forms a main substratum of the corner guard member 21. In the areas of the first and second outer portions 31 and 32, the first layer 23 has a primary thickness, herein designated a first thickness. In the areas of the first and second inner portions 33 and 34, the first layer 23 has a reduced thickness, herein designated a second thickness. A second layer 24 of thermoplastic material is applied onto the areas of reduced thickness of the first layer 23 of thermoplastic material and thereby forms the first and second inner portions 33 and 34 of the corner guard member 21. The second layer 24 of material has a thickness designated herein as a third thickness. When the second layer 24 is applied to the area of reduced thickness of the first layer, the total thickness of the corner guard member 21 in that area is equal to the primary thickness of the first layer of thermoplastic material. In other words, the first thickness of the first layer of thermoplastic material is equal to the second thickness of the first layer plus the third thickness of the second layer. The corner guard member 21 thereby has a constant thickness throughout its entire width.

The reduced thickness of the first layer is preferably, thought not necessarily, greater than one half of the primary thickness of the first layer. In other words, the second thickness is preferably greater that one half of the first thickness. The thickness of the second layer is preferably, though not necessarily, less than one half of the primary thickness of the first layer. In other words, the third thickness is preferably less than one half the first thickness. Thus, in a corner guard that has a primary thickness of, for example, 0.080 inches thick, the reduced thickness of the first layer of thermoplastic material, i.e., the second thickness, is preferably about 0.045 inches thick, and the thickness of the second layer of thermoplastic material, i.e., the third thickness, is preferably about 0.035 inches thick. Of course, the actual thickness of the materials may be modified depending on the particular material used and its application.

The first and second layers of thermoplastic material are comprised of two different colors of material. Furthermore, the second layer 24 is applied over the first layer 23 in a manner that will expose both layers of material, and thus both colors to view from the hallways. In reference to FIG. 3, the corner guard member 23 has an outer surface 27 and an inner surface 28. On the inner surface 28, the first layer 23 extends completely from one side edge 35 of the corner guard to the other side edge 36. The second layer 24 is applied onto outer surface of the first layer. Consequently, the first layer 23 of the first color of thermoplastic material is exposed to the outer surface 27 of the corner guard member 21 in the area of the first outer portion 31 of the first flat planar portion 25 and it is exposed in the area of the second outer portion 32 of the second flat planar portion 26. Additionally, the second layer 24 of the second color of thermoplastic material is exposed to the outer surface 27 of the corner guard member 21 in the area of the first inner portion 33 of the first flat planar portion 25 and it is exposed in the area of the second inner portion 34 of the second flat planar portion 26.

The relative widths of the inner and outer portions of the corner guard member, which are composed of the first and second colors of thermoplastic material, are preferably proportioned to provide a visual balance between the two colors. The relative widths are actually visually balanced better when the width of the inner portions is slightly less than the width of the adjacent outer portion. In a corner guard member that is, for example, three inches wide, meaning that the distance from the corner apex to the edge of the corner guard member measures three inches, the width of the inner portion is preferably about one-and-three-eighths inches wide (13/8 inches), and the width of the outer portion is preferably about one-and-five-eighths inches wide (15/8 inches). Because the inner portions are adjacent to each other, together they appear to be proportionally equal to the combined widths of the two outer portions of the corner guard member. The actual widths can of course be modified depending on the particular application of materials and the particular colors used.

Figure 5:
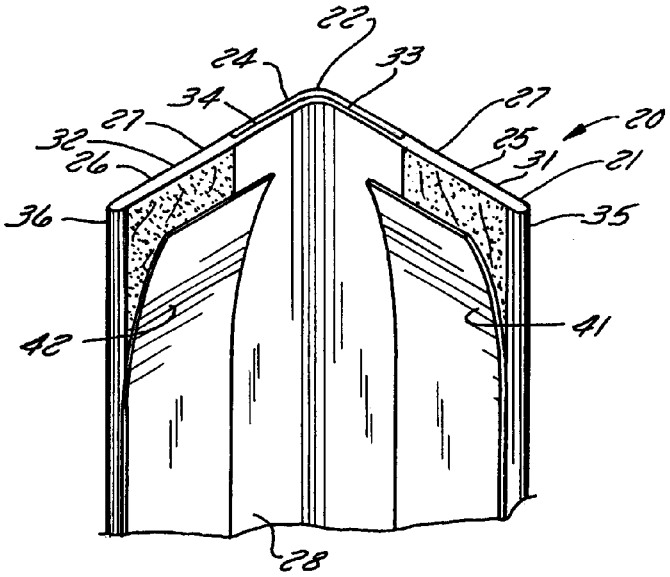
FIG. 5 is a perspective view illustrating the inner surfaces of the corner guard that are applied the surface of the building walls.

The multi-colored corner guard of the present invention may be fastened to the corner of the building wall with conventional double-sided, pressure sensitive adhesive tape. Referring to FIG. 5 in particular, the inner surface 28 of the corner guard member 21 is provided with two strips of adhesive tape. Specifically, a first strip 41 of adhesive tape is applied onto the inner surface 28 of the first flat planar portion 25 of the corner guard member 21, and a second strip 42 of adhesive tape is applied onto the inner surface 28 of the second flat planar portion 26 of the corner guard member. The corner guard is applied to the corner of a building wall by removing the liner on the adhesive and pressing the apex 22 of the corner guard member 21 tightly against the corner 10 of the building wall and thereby bonding the first flat planar portion 25 to the first wall surface 11 and further bonding the second flat planar portion 26 to the second wall surface 12.

Figure 6:
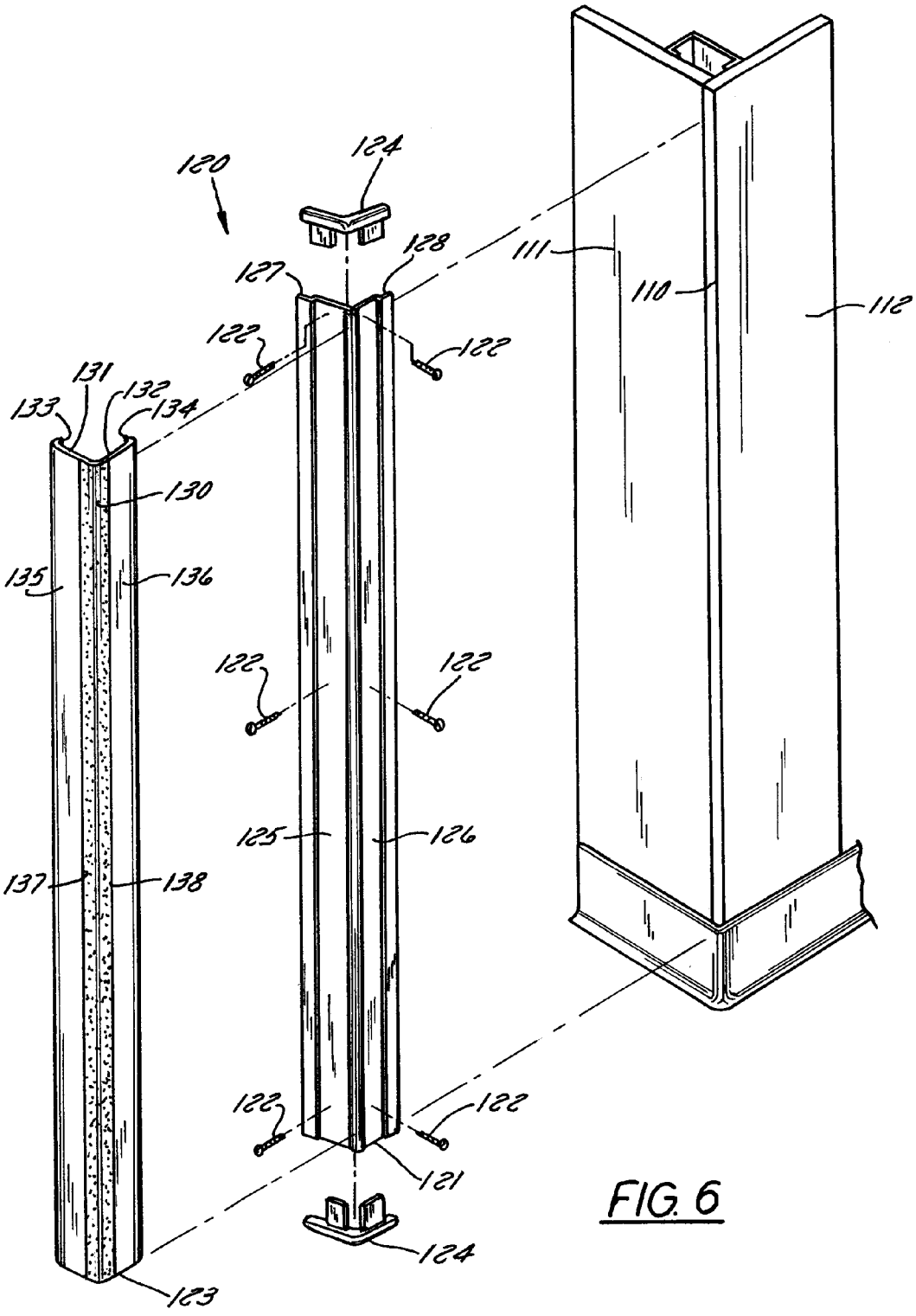
FIG. 6 is a perspective view illustrating a second embodiment of the corner guard of the present invention and the method that it is assembled to the corner of a building wall.

A second embodiment of the corner guard of the present invention is illustrated on FIG. 6. In FIG. 6, a corner guard assembly 120 is comprised of a retainer member 121, a plurality of fasteners 122 for fastening the retainer member to the corner 110 of the building wall, a corresponding cover member 123 assembled over the retainer member, and end caps 124 assembled to the upper and lower ends of the assembly.

The retainer member 121 is an elongated member including a first flat planar portion 125 and a second flat planar portion 126, the two flat planar portions each extending the entire length of the retainer member. The first flat planar portion 125 is applied over the first wall surface 111, and the second flat planar portion 126 is applied over the second wall surface 112. The first flat planar portion 125 intersects the second flat planar portion 126 preferably at an angle that corresponds to the angle of intersection of the first and second wall surfaces 111 and 112, which norm ally should be about 90°. The retainer member 121 may be made from a metallic material, which is typically aluminum, or it may be made of a thermoplastic material, preferably an extruded polyvinyl chloride plastic material (PVC). In the construction of building walls, the two intersecting wall surfaces 111 and 112 that form the corner 110 are occasional assembled together in a manner that does not form a precise right angle. In that event, a retainer member 121 made from a thermoplastic material may be flexed a slight amount in order to properly fit over the corner 110 of the building wall to which the corner guard assembly 120 is being applied.

On the retainer member 121, the first flat planar portion 125 has an offset edge portion 127 and the second flat planar portion 126 has a similar second offset edge portion 128. When the retainer member 121 is applied to the corner 110 of the wall, the first offset edge portion 127 is raised a slight distance from the surface of the first wall surface 111 of the building wall. Likewise, the second offset edge portion 128 is raised a slight distance away from the second wall surface 112. The first and second raised edge portions 127 and 128 form edges around which the cover member 123 is assembled. The retainer member 121 is fastened to the corner 110 of the building wall as illustrated in FIG. 6 with a plurality of fasteners 122, preferably self-tapping screws The cover member 123 is comprised of a first flat portion 131 and a second flat portion 132, the first and second flat portions intersecting at a rounded corner portion 130. The cover members 123 further includes a first inwardly turned, hooked shaped end portion 133 on the edge of the first flat surface 131, which hooks around for engagement to the first raised edge portion 127 of the retainer member 121. Likewise, a second inwardly turned, hooked shaped end portion 134 on the edge of the second flat surface 132 of the cover member 123 hooks around for engagement over the second raised edge portion 128 of the retainer member 121. Being vinyl, the cover member 123 is capable of deforming a slight amount to bend the two hook shaped end portions 133 and 134 apart from each other to fit over the opposing edges 127 and 128 of the retainer member 121, and then return to its original shape. Accordingly, the cover member 123 snaps in place and fits snugly over the retainer member 121. End caps 124 are applied to the upper and lower ends of the corner guard assembly.

Aside from the structural differences that make the cover member 123 capable of attachment to the retainer member 121, the cover member 123 illustrated in FIG. 6 is constructed in substantially the same manner as the corner guard member 20 discussed above and illustrated in FIGS. 1–5. That is, the first flat portion 131 of the cover member 123 illustrated in FIG. 6 is likewise comprised of a first outer portion 135 adjacent the edge of the cover member 123, and further comprised of a first inner portion 137 adjacent the rounded corner portion of the cover member 123. The second flat portion 132 is similarly comprised of a second outer portion 136 adjacent the other edge of the cover member 123, and further comprised of a second inner portion 138 also adjacent the rounded corner portion of the cover member 123. The cover member 123 is further comprised of a first layer of thermoplastic material that forms a main substratum, and a second layer of thermoplastic material of a different color applied over the first layer in a manner that will expose both layers of material, and thus both colors to view from the hallways The corner guard 20 and corner guard assemblies 120 disclosed herein may used as individual elements of a wall protection system, or used as components of a wall protection and color-coded marking system for both protecting the wall surfaces from damage and also for making specified locations within the building. Referring to FIG. 1, a wall protection and color-coded marking system may be comprised of color coordinated handrails, wall cove base and corner guards. The system may be comprised, for example, of a first handrail 14 and a first wall cove base 15 of a first color in a first hallway, a second handrail 16 and second wall cove base 17 of a second color in a second hallway, and a corner guard 20 of the present invention wherein the outer portions of the corner guard are of the first color, which matches the color of the first handrail and first wall cove base, and the inner portions of the corner guard are of the second color, which matches the color of the second handrail and second wall cove base. The colors of the walls 11 and 12 may also be coordinated to match the colors of the various components.

The multi-colored, co-extruded corner guard disclosed herein has a very desirable aesthetic appearance. Additionally, it may be used as part of a comprehensive system for designating and marking portions of buildings with color-coded components that also serve to protect the walls from damage. Of course, specific structural details disclosed above are not to be interpreted as limiting the scope of the invention, but represented merely as a basis for the claims and for teaching one skilled in the art to employ the present invention in any appropriately detailed structure. Changes may be made in the specific structural details of the particular embodiment disclosed above without departing from the spirit of the invention, especially as defined in the following claims.

What is claimed is:

1. A corner guard for protecting a corner of a hallway of a building from impacts, said corner being defined by the intersection of first and second flat wall surfaces, said corner guard comprising:

a corner guard member, said corner guard member having an elongated body including a first flat planer portion and a second flat planer portion, said first flat planer portion defining a first mounting surface to be applied over the first wall surface, and said second flat planer portion defining a second mounting surface to be applied over the second wall surface, the first and second flat planar portions being joined at a corner apex;

means for fastening said retainer member to said first and second flat wall surfaces;

the first flat planar portion of the corner guard member being further comprised of a first outer portion adjacent an edge of the first flat planar portion and a first inner portion adjacent the apex, and the second flat planar portion being further comprised of a second outer portion adjacent an edge of the second flat planar portion and a second inner portion adjacent the apex, the first and second outer portions being formed by a first layer of thermoplastic material of a first color and the first and second inner portion being formed by a second layer of thermoplastic material of a different color applied over the first layer.

2. The corner guard according to claim 1, wherein the first and second layers of thermoplastic material are co-extruded and bonded together in order to form a single integrated corner guard member.

3. The corner guard according to claim 2, wherein the corner guard member further comprises an inner surface and an outer surface, the outer surface being exposed to said hallway when the corner guard assembly is mounted to said corner, and the first and second layers being both exposed to the outer surface and thereby being visible from the hallway.

4. The corner guard according to claim 3, wherein the first and second layers are bonded to each other so that the cover member has a constant thickness across its entire width.

5. The corner guard assembly according to claim 4, wherein:

the first layer has a first thickness in the areas of the first and second outer portions, and the first layer further has a reduced second thickness in the areas of the first and second inner portions;

the second layer of thermoplastic material is applied onto the areas of reduced second thickness of the first layer of thermoplastic material to thereby form the first and second inner portions of the corner guard member; and, the second layer of thermoplastic material has a third thickness;

wherein the first thickness of the first layer of thermoplastic material is equal to the reduced second thickness of the first layer plus the third thickness of the second layer.

6. The corner guard assembly according to claim 5, wherein the first and second outer portions have equal widths.

7. The corner guard assembly according to claim 6, wherein the first and second inner portions have equal widths.

8. The corner guard assembly according to claim 7, further comprising:

a first handrail mounted to the first wall surface, the first handrail being comprised of a thermoplastic material that matches the first color of the first layer of thermoplastic material of the cover member; and, a second handrail mounted to the second wall surface, the second handrail being comprised of a thermoplastic material that matches the second color of the second layer of thermoplastic material of the cover member.

9. A corner guard assembly for protecting a corner of a hallway of a building from impacts, said corner being defined by the intersection of first and second flat wall surfaces, said corner guard assembly comprising:

a retainer member, said retainer member having an elongated main body including a first flat planer portion and a second flat planer portion, said first flat planer portion defining a first mounting surface to be applied over the first wall surface, and said second flat planer portion defining a second mounting surface to be applied over the second wall surface, the first flat planer portion further including an offset edge portion that is raised a slight distance from the surface of the first wall surface, and the second flat planar portion further includes a second offset edge portion that is raised a slight distance away from the second wall surface;

means for fastening said retainer member to said first and second flat wall surfaces;

a decorative cover member which is assembled over the retainer member, said cover member including a first flat cover portion and a second flat cover portion, the first and second flat cover portions intersecting at a corner portion, the cover members further including a first inwardly turned, hooked shaped end portion on the edge of the first flat surface that hooks around for engagement to the first offset edge portion of the retainer member and a second inwardly turned, hooked shaped end portion on the edge of the second flat surface of the cover member that hooks around for engagement over the second offset edge portion of the retainer member; the first flat cover portion of the cover member being further comprised of a first outer portion adjacent the first hooked shaped end portion and a first inner portion adjacent the corner portion of the cover member, and the second flat portion being further comprised of a second outer portion adjacent the second hooked shaped end portion and a second inner portion adjacent the corner portion of the cover member, the first and second outer portions being formed by a of a first layer of thermoplastic material of a first color and the first and second inner portion being formed by a second layer of thermoplastic material of a different color applied over the first layer.

10. The corner guard assembly according to claim 9, wherein the first and second layers of thermoplastic material are co-extruded and bonded together in order to form a single integrated cover member.

11. The corner guard assembly according to claim 10, wherein the cover member further comprises an inner surface and an outer surface, the outer surface exposed to said hallway when the corner guard assembly is mounted to said corner, and wherein the first and second layers are both exposed to the outer surface and are thus visible from the hallway.

12. The corner guard assembly according to claim 11, wherein the first and second layers are bonded to each other so that the cover member has a constant thickness across its entire width.

13. The corner guard assembly according to claim 12, wherein:

the first layer has a first thickness in the areas of the first and second outer portions, and the first layer further has a reduced second thickness in the areas of the first and second inner portions;

the second layer of thermoplastic material is applied onto the areas of reduced second thickness of the first layer of thermoplastic material to thereby form the first and second inner portions of the corner guard member; and, the second layer of thermoplastic material has a third thickness;

wherein the first thickness of the first layer of thermoplastic material is equal to the second thickness of the first layer plus the third thickness of the second layer.

14. The corner guard assembly according to claim 13, further comprising end caps applied to upper and lower ends of the corner guard assembly.

15. The corner guard assembly according to claim 14, further comprising:

a first handrail mounted to the first wall surface, the first handrail being comprised of a thermoplastic material that matches the first color of the first layer of thermoplastic material of the cover member; and, a second handrail mounted to the second wall surface, the second handrail being comprised of a thermoplastic material that matches the second color of the second layer of thermoplastic material of the cover member.

* * * * *

UNITED STATES PATENT AND TRADEMARK OFFICE

CERTIFICATE OF CORRECTION

PATENT NO. : 6,263,630 B1
DATED : July 24, 2001
INVENTOR(S) : Bennett

It is certified that error appears in the above-identified patent and that said Letters Patent is hereby corrected as shown below:

Column 7,
Line 6, change "retainer member" to read -- corner guard member --.
Lines 31-32, change "cover member" to read -- corner guard member --.

Signed and Sealed this

Ninth Day of April, 2002

*Attest:*

*Attesting Officer*

JAMES E. ROGAN
*Director of the United States Patent and Trademark Office*